US006672014B1

(12) United States Patent
Jones

(10) Patent No.: US 6,672,014 B1
(45) **Date of Patent: *Jan. 6, 2004**

(54) STRUCTURAL SUPPORT AND POSITIONING SYSTEM FOR ANGULARLY DIRECTED STRUCTURAL SUPPORT MEMBERS

(76) Inventor: Terry V. Jones, 1804 Clay Ave., Terre Haute, IN (US) 47805

( * ) Notice: Subject to any disclaimer, the term of this patent is extended or adjusted under 35 U.S.C. 154(b) by 0 days.

This patent is subject to a terminal disclaimer.

(21) Appl. No.: 10/216,763

(22) Filed: Aug. 13, 2002

(51) Int. Cl.[7] ..... E04B 7/04

(52) U.S. Cl. ..... 52/92.2; 52/92.1; 52/93.1; 52/93.2; 52/127.2; 52/241; 52/290; 52/300; 52/690; 52/677; 52/697; 52/698; 52/696

(58) Field of Search ..... 52/92.2, 92.1, 52/712, 677, 93.1, 290, 697, 8, 690, 696, 127.2, 300, 241, 93.2

(56) References Cited

U.S. PATENT DOCUMENTS

| | | | | | |
|---|---|---|---|---|---|
| 1,803,723 | A | | 5/1931 | Murphy | |
| 1,988,388 | A | * | 1/1935 | Mioton | 52/92.2 |
| 2,902,951 | A | * | 9/1959 | Magg | 52/692 |
| 2,911,022 | A | * | 11/1959 | Brown | 269/40 |
| 2,964,807 | A | * | 12/1960 | Kennedy | 52/696 |
| 2,966,708 | A | | 1/1961 | Freeman | |
| 3,289,362 | A | | 12/1966 | Whelan | |
| 3,360,892 | A | * | 1/1968 | Rosso | 52/93.1 |
| 3,390,494 | A | * | 7/1968 | Chappie | 52/105 |
| 3,421,270 | A | | 1/1969 | Chaney | |
| 3,672,112 | A | * | 6/1972 | Sions et al. | 52/712 |
| 3,925,954 | A | * | 12/1975 | Snow et al. | 403/188 |
| 3,959,945 | A | | 6/1976 | Allen | |
| 3,967,908 | A | * | 7/1976 | Snow et al. | 403/219 |
| 4,080,771 | A | * | 3/1978 | Weller | 52/737.3 |
| 4,122,647 | A | | 10/1978 | Kovar | |
| 4,229,915 | A | * | 10/1980 | Snow et al. | 52/92.2 |
| 4,246,736 | A | | 1/1981 | Kovar et al. | |
| 4,361,999 | A | | 12/1982 | Sidney | |
| 4,410,294 | A | * | 10/1983 | Gilb et al. | 403/27 |
| 4,490,956 | A | | 1/1985 | Palacio et al. | |
| 4,596,101 | A | * | 6/1986 | Brinker | 52/317 |
| 4,604,845 | A | * | 8/1986 | Brinker | 52/696 |
| 4,637,195 | A | * | 1/1987 | Davis | 52/693 |
| 4,669,235 | A | * | 6/1987 | Reinen | 52/98 |
| 4,704,829 | A | * | 11/1987 | Baumker, Jr. | 52/127.2 |
| 4,878,323 | A | * | 11/1989 | Nelson | 52/92.2 |
| 4,965,980 | A | * | 10/1990 | Leavens | 52/712 |
| 4,986,052 | A | * | 1/1991 | Nelson | 52/745.06 |

(List continued on next page.)

FOREIGN PATENT DOCUMENTS

| | | |
|---|---|---|
| DE | 3213358 A1 | 6/1983 |
| FR | 1477830 | 7/1967 |

*Primary Examiner*—Carl D. Friedman
*Assistant Examiner*—Christy Green
(74) *Attorney, Agent, or Firm*—Rosenberg, Klein & Lee

(57) ABSTRACT

A system (100) for positioning and securing angularly directed structural support members (20) to a longitudinally extended structural member (30) of a building includes at least a pair of mounting devices (105, 105', 105") respectively mounted to at least one longitudinally extended structural member (30). Each mounting device (105, 105', 105") includes a base plate (110) having a plurality of pairs of fixing members (120, 120', 120") disposed in spaced longitudinal relationship. A space (118) between each of the pairs of fixing members (120, 120', 120") is provided for receiving the angularly directed structural support member (20) therein. Each of the fixing members (120, 120', 120") are formed by angularly directed C-shaped channel members. Each channel member has a central web portion (130) bounded on two vertically directed sides by a pair of flanges (132) expending in a longitudinal direction. The flanges provide lateral stability and torsion resistance to the support of corresponding angularly directed structural support members (20).

20 Claims, 5 Drawing Sheets

U.S. PATENT DOCUMENTS 5,236,273 A * 8/1993 Gilb ..... 403/232.1
5,240,342 A * 8/1993 Kresa, Jr. ..... 403/232.1
5,370,577 A * 12/1994 Jonett et al. ..... 454/260
5,412,920 A 5/1995 Hess
5,524,397 A * 6/1996 Byers et al. ..... 52/92.2
5,551,200 A * 9/1996 Krug ..... 52/696
5,596,859 A * 1/1997 Horton et al. ..... 52/733.3
5,596,860 A * 1/1997 Hacker ..... 52/763
5,606,837 A * 3/1997 Holizlander ..... 52/693
5,857,306 A * 1/1999 Pellock ..... 52/643
5,870,874 A * 2/1999 Brothers ..... 52/696
5,884,448 A 3/1999 Pellock
5,946,879 A * 9/1999 Pellock ..... 52/690
6,170,218 B1 * 1/2001 Shahnazarian ..... 52/713
6,174,119 B1 * 1/2001 Orr ..... 411/461
6,219,975 B1 * 4/2001 Olden ..... 52/92.2
6,295,781 B1 * 10/2001 Thompson ..... 52/712
6,332,299 B1 * 12/2001 Stewart, III ..... 52/696
6,401,423 B1 * 6/2002 Bergeron et al. ..... 52/733.3
6,412,233 B1 * 7/2002 Jones ..... 52/92.2
6,418,694 B1 * 7/2002 Daudet et al. ..... 52/650.1
6,493,998 B1 * 12/2002 Pryor ..... 52/92.2

* cited by examiner

STRUCTURAL SUPPORT AND POSITIONING SYSTEM FOR ANGULARLY DIRECTED STRUCTURAL SUPPORT MEMBERS

BACKGROUND OF THE INVENTION

1. Field of the Invention

This invention directs itself to construction systems utilized for properly locating angularly directed structural support members of a roof structure that extend between longitudinally extended and laterally spaced supporting members. In particular, this invention directs itself to a system wherein at least a pair of mounting devices are respectively mounted to a corresponding surface portion of at least one longitudinally extended structural member. Each of the pair of mounting devices is provided with a plurality of angularly directed structural member receiving spaces. Still further, the present invention includes mounting devices formed by a longitudinally extended base plate having at least a plurality of pairs of first fixing members respectively secured thereto. Each pair of first fixing members is disposed in opposing spaced parallel relationship to define respective structural member receiving spaces therebetween. More in particular, this invention pertains to mounting devices wherein the fixing members are formed by angularly directed C-shaped channel members, each having a web portion bounded on two sides thereof by a pair of flanges extending in the longitudinal direction. Still further, the first fixing members are directed at an elevation angle, a lateral angle of inclination, or both, that are less than 90° with respect to a plane defined by the base plate.

2. Prior Art

Construction devices for positioning and securing structural members to supporting walls are well known in the art. The best prior art known to Applicant include U.S. Pat. Nos. 4,080,771; 4,669,235; 4,878,323; 3,390,494; 5,412,920; 2,964,807; 4,246,736; 4,361,999; 3,421,270; 3,289,362; 3,959,945; 4,490,956; 5,606,837; 5,884,448; 4,596,101; 4,637,195; 4,122,647; and, 4,704,829.

In some prior art systems, such as that disclosed by U.S. Pat. Nos. 4,080,771 and 4,669,235, there are provided truss aligning systems which become an integral part of the building structure when it is completed. In such systems, a flat metal member is provided which is mounted to the top plate of a building frame. The flat metal member has a plurality of pairs of upstanding flanges laterally spaced along the plate. Each of the pair of flanges are spaced apart one from another by a distance corresponding to the thickness of a roof truss or other structural member. Each of the flanges is provided with a plurality of apertures through which fasteners can be driven to secure the structural member thereto. However, such systems fail to disclose upstanding flanges formed by vertically directed C-shaped channels, wherein flange portions thereof extend in a longitudinal direction to rigidly support the web portion disposed between the flanges in a vertical orientation.

In other prior art systems, such as that disclosed by U.S. Pat. 5,412,920, an article for connecting laterally spaced beams is provided. Such structures engage the building members between respective clasping members. The two pair of opposing clasping members are interconnected by a spanning member, and reinforced by a web member extending therebetween. Such connecting devices fail to provide a web which is centrally disposed on the spanning portion and flanges, to maximize the resistance to deformation thereof.

SUMMARY OF THE INVENTION

A system for positioning and securing angularly directed structural support members of a roof structure is provided.

The system includes at least a pair of mounting devices respectively mounted to corresponding surface portions of a pair of longitudinally extended and laterally spaced structural members. The pair of mounting devices each has a plurality of angularly directed structural support member receiving spaces formed thereon in correspondence with the other of the mounting devices. Each of the mounting devices includes a longitudinally extended base plate having a plurality of longitudinally spaced first through holes formed therein, through which fasteners pass for coupling the base plate to a respective longitudinally extended structural member. Each mounting device also includes a plurality of pairs of first fixing members respectively secured to the base plate. Each of the pair of first fixing members is disposed in opposed spaced parallel relationship to define a respective one of the receiving spaces therebetween for locating and securing a portion of a respective angularly directed structural support member to the corresponding longitudinally extended structural member. Each of the first fixing members is formed by an angularly directed C-shaped channel member having a web portion bounded on two sides thereof by a pair of flanges extending substantially in the longitudinal direction.

From another perspective, a system for positioning and securing angularly directed structural support members of a roof structure is provided that includes at least a pair of mounting devices consecutively mounted to a surface of a respective longitudinally extended structural member. Each of the plurality of mounting devices has a plurality of angularly directed structural support member first receiving spaces formed thereon and an additional angularly directed structural support member second receiving space formed at an interface between the consecutively positioned pair of the mounting devices. Each of the mounting devices includes a longitudinally extended base plate having a plurality of longitudinally spaced first through holes formed therein, through which fasteners pass for coupling the base plate to the longitudinally extended structural member. Each mounting device includes a plurality of pairs of first fixing members respectively secured to the base plate. Each of the pair of first fixing members is disposed in opposing spaced parallel relationship to define a respective one of said first receiving spaces therebetween for locating and securing a portion of a respective angularly directed structural support member to the longitudinally extended structural member. Each of said first fixing members is formed by an angularly directed C-shaped channel member having a web portion bounded on two sides thereof by a pair of flanges extending substantially in said longitudinal direction. Each mounting device further includes a pair of opposed second fixing members respectively secured to the base plate adjacent opposing ends thereof. Each of said second fixing members is formed by an angularly directed C-shaped channel member having a web portion bounded on two sides thereof by a pair of flanges extending in said longitudinal direction. A first of said second fixing members is secured to the base plate at an endmost location and the second of the second fixing members is secured to the base plate at a location from which a pair of laterally spaced tabs extend. The spaced tabs of one mounting device are disposed adjacent the first of the second fixing members of the consecutively positioned mounting device to define the second receiving space between the first of the second fixing members of one mounting device and the second of the second fixing members of the other mounting device.

DESCRIPTION OF THE PREFERRED EMBODIMENTS

Figures 1, 1A:
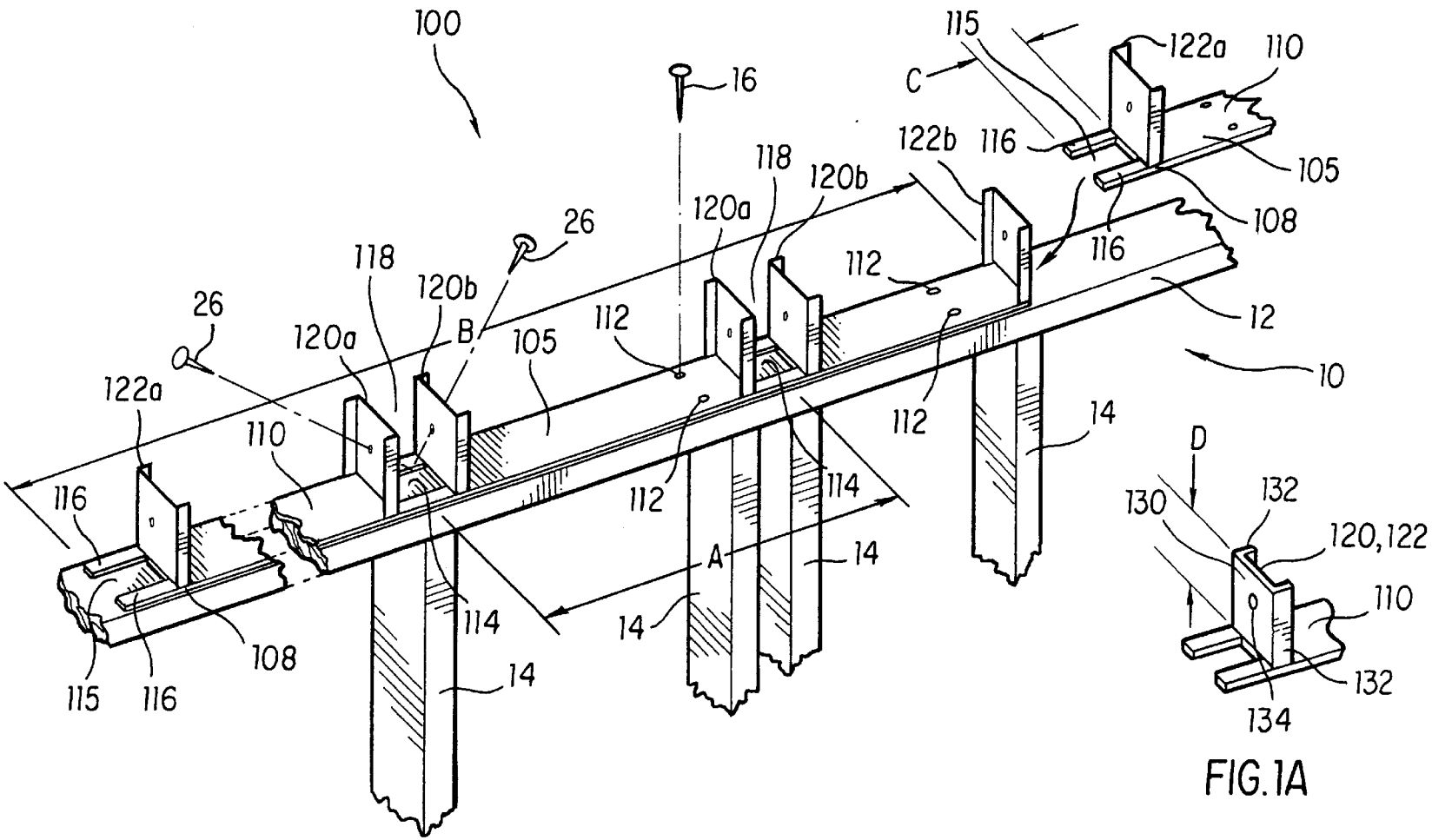
FIG. 1 is a perspective view of the basic structure of the present invention.
FIG. 1A is a cut-away perspective view of a fixing member of the present invention.

Referring now to FIGS. 1 and 1A, there is shown structural support and positioning system 100 for securing and properly locating angularly directed structural members of a roof structure of a building during its construction. System 100 becomes a permanent part of a completed building, and facilitates the rapid setting of structural roofing members such as trusses or hip, jack, valley, and common rafters, or the like, between respective longitudinally extended structural members, such as top plates of supporting walls 10 or rafters, and provides improved strength of the resulting building structure.

As shown in FIGS. 1, and 1A, structural support and positioning system 100 includes a plurality of mounting devices 105 respectively mounted to a substantially horizontal surface portion of a respective longitudinally extended building supporting wall 10. Typically, mounting devices 105 are mounted on each of at least a pair of longitudinally extended structural members between which angularly directed structural members extend. However, the mounting devices may be utilized to position and support only one end of the angularly directed structural roof members or roof trusses. Each of the mounting devices 105 has a plurality of structural member receiving spaces 18 formed thereon in respective correspondence each with another, so that structural building members 20 (shown in FIGS. 2–5) can be positioned to extend between parallel supporting walls 10 in properly spaced relationship. Thus, the mounting device 105 can be secured to the header or top plate 12 that is supported by a plurality of studs 14 of a framed wall 10. The top plate 12 may be formed by one or more individual members, and formed of wood, metal, laminated or composite materials, as permitted or required by local building codes, without departing from the spirit or scope of the inventive concepts disclosed herein. Each mounting device 105 is formed by a longitudinally extended base plate 110 having a plurality of holes 112 formed therethrough. Through holes 112 provide a passage for fasteners 16 to secure the base plate 110 to the top plate 12. Fasteners 16 may be screws, staples, nails or bolts, as appropriate to the material of top plate 12 and local building codes.

Each mounting device 105 further includes a plurality of pairs of fixing member 120 respectively secured to the base plate 110. Each pair of fixing members 120 are disposed in opposing spaced parallel relationship and between which is defined a respective one of a plurality of structural member receiving spaces 118. Each of the pair of fixing members 120 is formed by two angularly directed C-shaped channel members 120*a* and 120*b* disposed in opposing spaced relationship. In the configuration of FIGS. 1 and 1A, each fixing member is angularly directed at an angle approximating 90° with respect to the plane defined by the base plate 110, both laterally and in elevation to extend substantially vertically when base plate 110 is substantially horizontal. Each C-shaped channel member 120*a*, 120*b* is formed by a web portion 130 bounded on two opposing sides by a pair of flanges 132 extending in the longitudinal direction. The flanges 132 of the C-shaped channel member 120*a* extend in an opposite direction from the flanges 132 of the C-shaped channel member 120*b*. Thus, the flanges 132 of each of the fixing members 120*a* and 120*b* are directed away from the corresponding structural member receiving space 118.

The use of C-shaped channel members to form the fixing members, with their oppositely directed flanges, is of critical importance to the structural integrity of the mounting device 105, and thereby the functionality of structural member support and positioning system 100. The oppositely directed flanges of each of the channel members 120*a*, 120*b* provides for an extremely rigid angularly directed structure to provide improved lateral stability and torsion resistance to the support of corresponding angularly directed structural support members. The rigid angularly directed structure also provides for the improved structural integrity of the mounting device 105, insuring that the angular orientation of the channel members are maintained during shipment and storage.

Each mounting device 105 may further include one fixing member 122 secured to one longitudinal end of base plate 110, or a pair of opposed fixing members 122 respectively secured to the base plate 110 adjacent opposing longitudinal ends thereof. Like the fixing members 120, fixing members 122 are formed by angularly directed (in this case vertically directed) C-shaped channel members 122*a*, 122*b* having a web portion 130 bounded on two opposing sides by a pair of flanges 132 expending in a longitudinal direction. Although the fixing members 122*a* and 122*b* are disposed at opposing ends of base plate 110, the respective flanges 132 thereof extend in opposite directions. Where only one fixing member 122 is used, the flanges 132 extend away from the respective longitudinal end to which the fixing member 122 is secured. The C-shaped channel members which form the fixing members 120, 122 are secured to the base plate 110 by welding, in one working embodiment. Other techniques for securing the C-shaped channels to the base plate 110 may also be utilized, for example, extending portions of the flanges 132 through corresponding openings formed in the base plate and securing the flanges therein, forming a flange on a bottom end of the C-shaped channel members for coupling to base plate 110 with fasteners, spot welding, an adhesive, or other means.

The use of C-shaped channel members to form the fixing members 122 is critically important to the structural integrity of mounting device 105, for the same reasons as discussed above with respect to fixing members 120. As will be explained further in following paragraphs, in some applications, it is important that one of the fixing members 122*b* be located at an endmost location on the base plate 110 and the other of the fixing members 122*a* be secured to the base plate at a location 108 from which a pair of tabs 116 extend.

As is common in construction practice, such building structural members as roof trusses and floor joists are typically joined to supporting walls utilizing a fastening technique known as "toenailing" wherein a fastener is driven angularly through a side of the structural member to exit a bottom surface thereof for securement into the upper member of a supporting wall. Mounting devices 105 support the use of the "toenailing" technique in that the base plate 110 of each mounting device 105 includes a plurality of openings 114 formed therethrough in coincidence with each structural member receiving space 118 thereof, and an opening 115 disposed between the pair of tabs 116. Thus, between each pair of fixing members 120 there is disposed an opening 114 formed through the base plate 110 through which a fastener exiting a bottom surface of a corresponding structural member can pass for entry into the header 12. The opening 115 disposed between tabs 116 similarly serves the same function. Thus, a fastener 26 can be angularly passed through the opening 134 in a respective web portion 130 of a fixing member 120, 122 to secure the angularly directed structural support member to the top plate 12, and thereby secure the angularly directed structural support member to the mounting device 105, as well.

As can be seen in FIGS. 1 and 1A, each mounting device 105 has an overall longitudinal dimension B which is selected to be a standard length suitable for the construction industry. The longitudinal dimension B of each mounting device 105 may be 8, 12 or 16 feet, for example. The center-to-center distance A between adjacent structural member receiving spaces 118 is also selected to be a standard utilized in the construction industry, such as 16 inches or 24 inches. Obviously, the dimensions A and B can be other than those mentioned above without departing from the inventive concepts disclosed herein. The distance between the pairs of fixing members 120*a* and 120*b* is equal to the thickness of the angularly directed structural support member intended to be positioned therebetween. It is, however, important that the length C of the tabs 116 be equal to the thickness of the angularly directed structural support member being positioned between the fixing members 122*a* and 122b. In that way, the mounting devices 105 can be consecutively positioned on the top plate 12, one following another, while maintaining the appropriate center-to-center distance A between the receiving spaces 118 of one mounting device 105 with those of an adjoining one. Where an endmost angularly directed structural support member is a support like a hip rafter, the use of a C-shaped channel member adjacent thereto may be undesirable do to space limitations with adjacent hip jacks or other considerations. In such applications, a mounting device 105 is provided with only one C-shaped channel member 122 at the longitudinal end of base plate 110 that is distal from the endmost angularly directed structural support member. Where mounting device 105 spans between two such endmost angularly directed structural support members, only fixing members 120 are coupled to base plate 110.

The height dimension D of the C-shaped channel members 120, 122 is also important to the stable support of the angularly directed structural support members. The greater the height dimension D with respect to the height of the structural support member, the more stable the base of support. In one working embodiment, the height dimension D is in the approximating range of 3–4 inches. In the modified forms of system 100, as will be discussed in following paragraphs, fixing members 120, 122 may be angularly directed at the same angle as that of the structural support members. Thus, the height of those members is not a limitation on the length of the C-shaped channel members 120, 122. An angularly directed structural support member that is positioned in a respective receiving space 118 is secured therein through the use of fasteners 26 passed through one or more through holes 134 formed in the fixing members 120.

Figure 2:
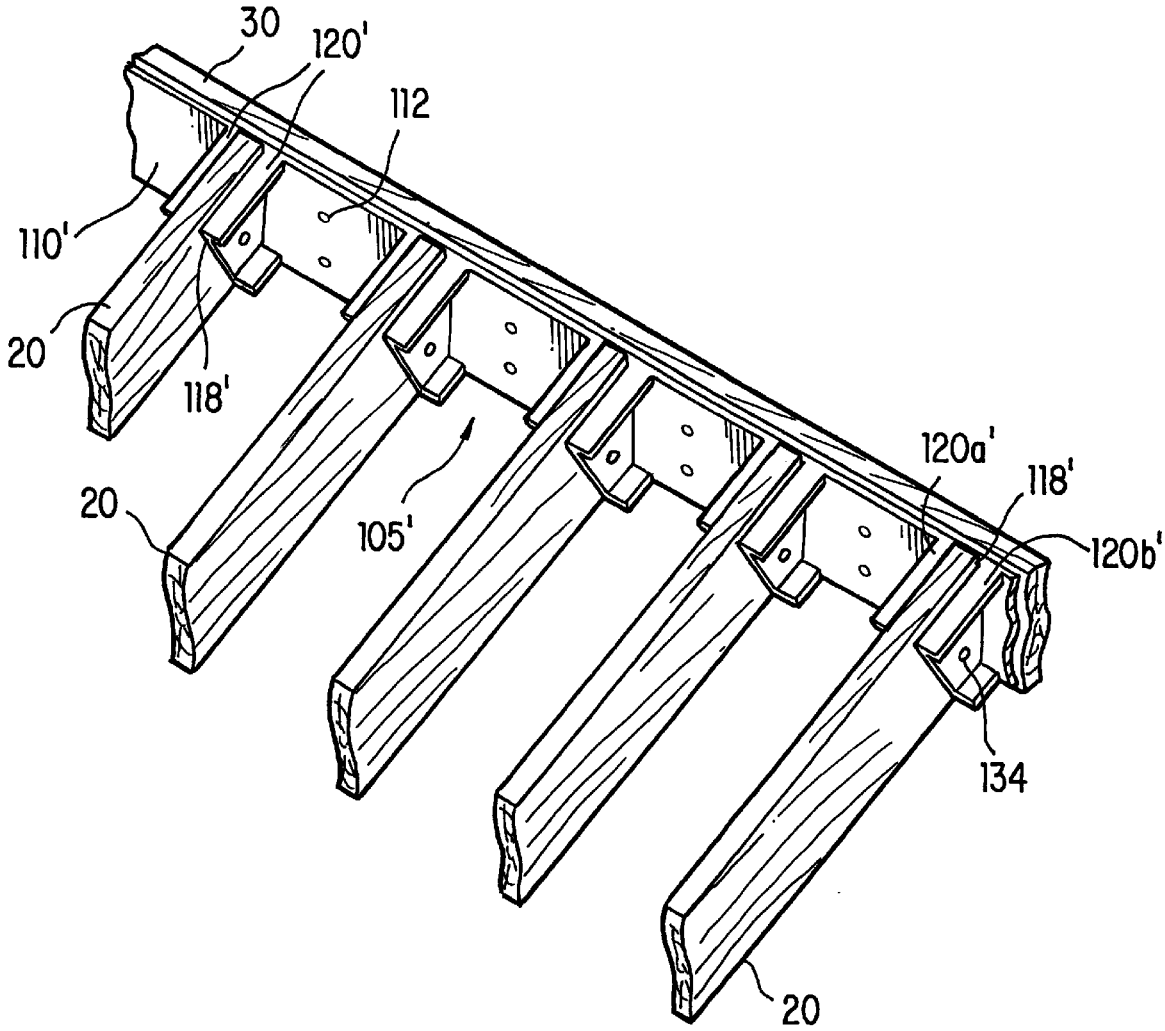
FIG. 2 is a perspective view of a first modified form of the present invention.
Figure 4:
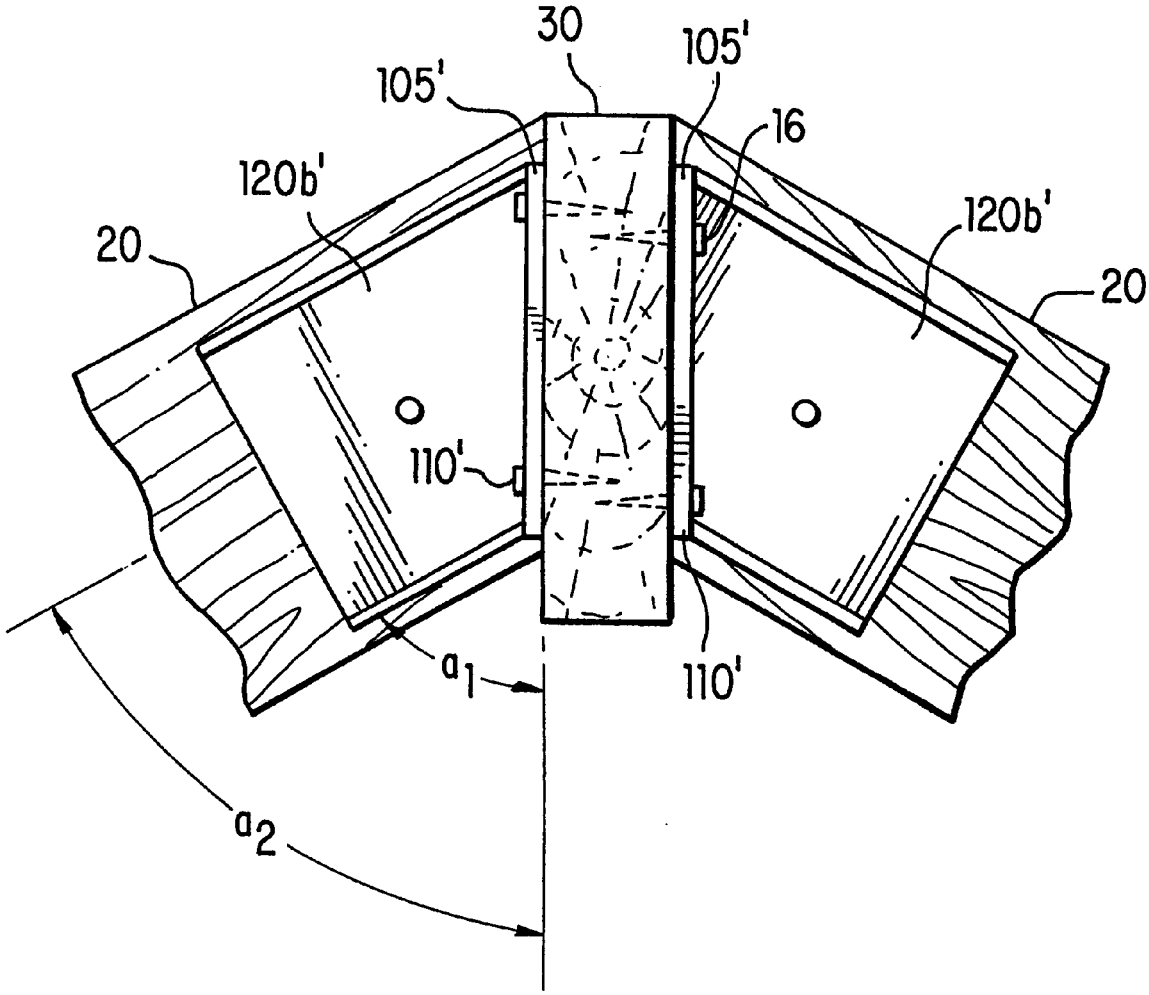
FIG. 4 is an elevation view of an application of the first modified form of the present invention; and, FIG. 5 is a perspective view illustrating an application of the present invention using both the first and second modified forms thereof.
Figure 5:
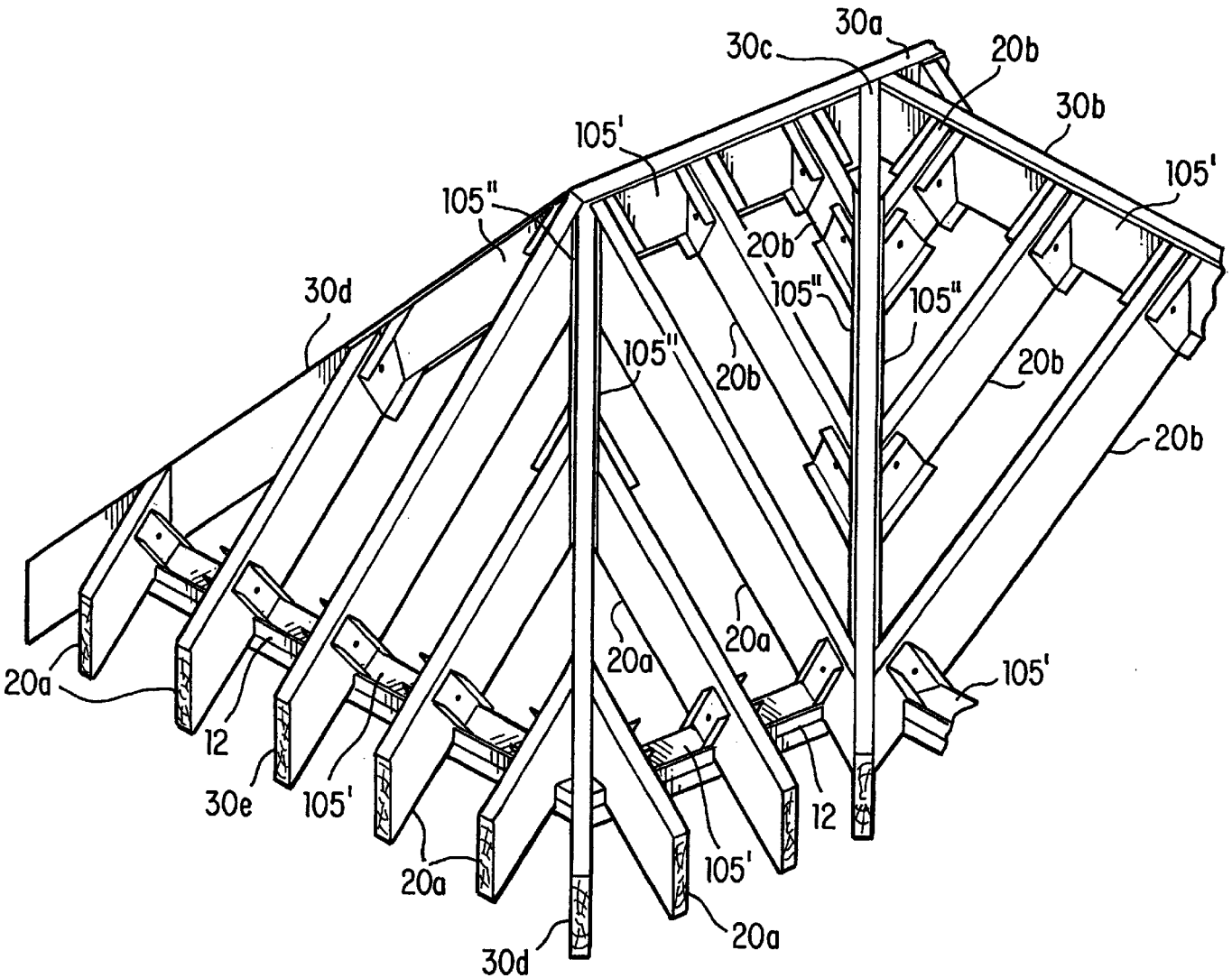

In FIGS. 2, 4 and 5, a first modified form of structural support and positioning system 100 is shown. In this arrangement, a mounting device 105'0 is utilized, which is a modified form of the mounting device 105' shown in FIG. 1. An application of mounting device 105' is typically the support and alignment of jack rafters, such as hip jacks and valley jacks. Except as otherwise indicated below, mounting device 105' is identical to mounting device 105.

Each mounting device 105' of system 100 is mounted on a longitudinally extended structural member 12, 30, such as a top plate or ridge board. Each mounting device 105' has a plurality of receiving spaces 118' for locating and securing a portion of a respective angularly directed structural support member 20 therein, in order to secure such to the corresponding longitudinally extended structural member 12, 30. Mounting device 105' is formed by a longitudinally extended base plate 110' having a plurality of holes 112 formed therethrough for passage of fasteners 16 to secure the base plate 110' to a respective longitudinally extended structural member 12, 30. Mounting device 105' further includes a plurality of pairs of fixing members 120' respectively secured to the base plate 110'. Each pair of fixing members 120' are disposed in opposing parallel relationship and between which is defined a respective one of a plurality of receiving spaces 118'.

Each of the pair of fixing members 120' is formed by two angularly directed C-shaped channel members 120*a'* and 120*b'* disposed in opposing spaced relationship. Each fixing member 120*a'*, 120*b'* is angularly directed at a lateral angle of inclination $a_1$, as shown in FIG. 4. The lateral angle of inclination $a_1$ is less than 90°. Ideally, the angle $a_1$ is the same as the angle $a_2$ of a respective angularly directed structural support member 20*b* being supported thereby, where mounting device 105' is mounted to a ridge board 30*a*, 30*b*, or normal to a respective jack rafter 20*a* or common rafter 30*e*, where the mounting device 105' is mounted to a top plate 12, as shown in FIG. 5. For some applications, it may not be necessary to direct the C-shaped channel members 120*a'* and 120*b'* at an angle which exactly coincides with the angle of the rafter being supported, or perpendicularly intersects such angle to provide adequate support of the rafter. Each C-shaped channel member 120*a'*, 120*b'* is formed by a web portion that is bounded on two opposing sides by a pair of flanges extending in the longitudinal direction, as previously described. The web portion of each C-shaped channel member 120*a'*, 120*b'* has at least one through hole 134 formed therein through which a fastener may extend to secure the angularly directed structural support member in place. Mounting device 105' may also include second fixing members at opposing ends of base plate 110' . Where second fixing members are included, one end of base plate 110' is provided with a pair of laterally spaced tabs, as previously described.

Figure 3:
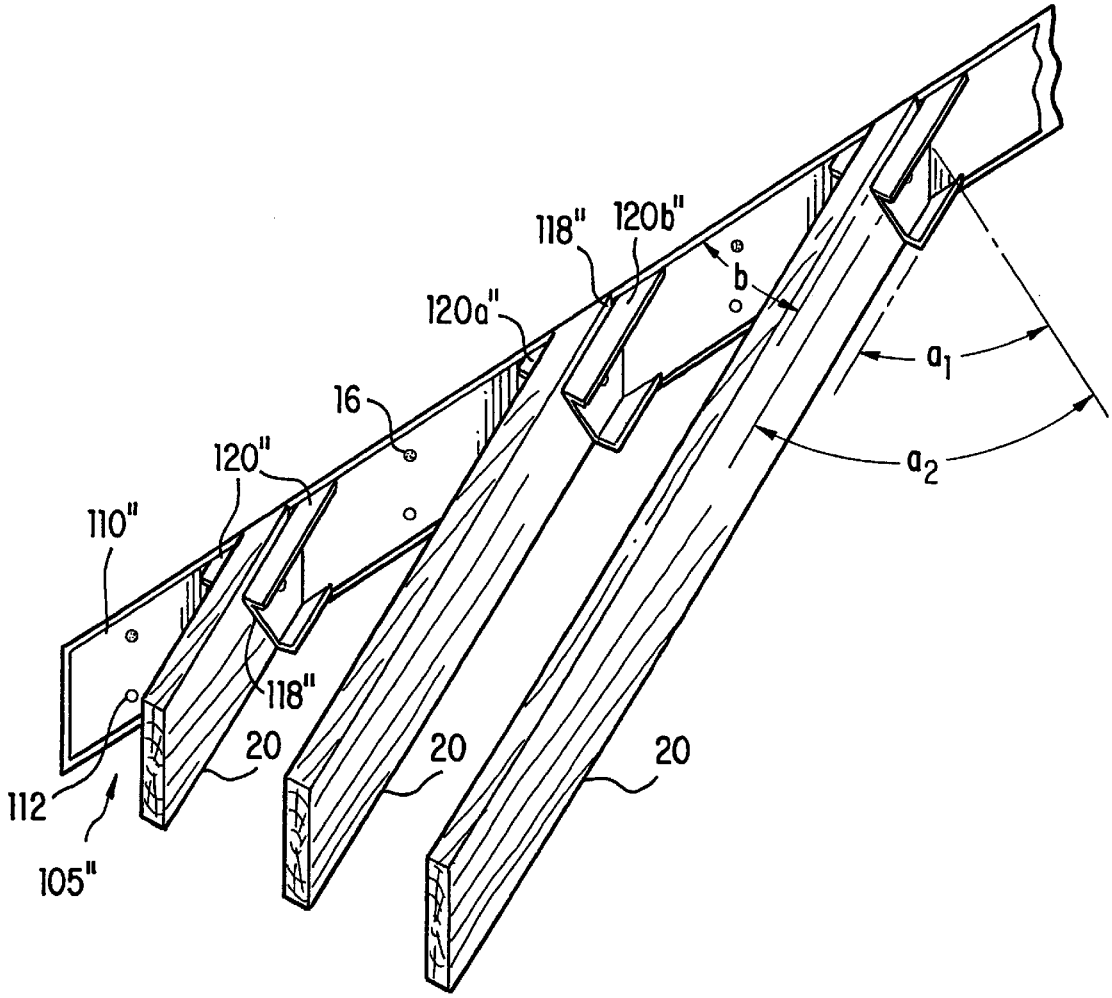
FIG. 3 is a perspective view of a second modified form of the present invention.

Referring now to FIGS. 3 and 5, there is shown a second modified form of system 100. In this arrangement, a mounting device 105" is utilized, the mounting device 105" being a modified form of the mounting device 105 shown in FIG. 1. An application of mounting device 105" is typically for mounting to hip and valley rafters 30*d* and 30*c* for coupling and aligning jack rafters 20*a*, 20*b* thereto. Except as otherwise indicated below, mounting device 105" is identical to the mounting device 105 of FIG. 1. Mounting device 105" is formed by a longitudinally extended base plate 110" having a plurality of holes 112 formed therethrough for passage of fasteners 16 to secure the device 105" to the longitudinally extended structural member 30. Each mounting device 105" includes a plurality of pairs of fixing members 120" respectively secured to the base plate 110". Each pair of fixing members 120" are disposed in opposing spaced parallel relationship and between which is defined a respective one of a plurality of receiving spaces 118" into which a respective angularly directed structural support member is received.

Each of the pair of fixing members 120" is formed by two angularly directed C-shaped channel members 120*a*" and 120*b*" disposed in opposed spaced relationship. In this configuration, the C-shaped channel members 120*a*" and 120*b*" are offset in two directions with respect to the plane defined by the longitudinally extended base plate 110". With respect to a direction transverse to the longitudinal direction of base plate 110', the pairs of fixing members 120" are directed at a lateral angle of inclination $a_1$, which angle is ideally equal to the angle $a_2$ of the angularly directed support member 20, as in the configuration for the mounting device 105'. The lateral angle of inclination $a_1$ is an angle less than 90° with respect to the plane defined by the base plate 110". In addition to the lateral angle of inclination $a_1$, the fixing members 120" are also directed at an elevation angle b which is less than 90° with respect to the plane defined by the base plate. The elevation angle b, like the angle of inclination $a_1$, ideally also coincides with the angle of the angularly directed structural support members 20. As shown in FIG. 5, the hip and valley jacks 20*a* and 20*b* respectively intersect the hip rafters 30*d* and valley rafters 30*c* at compound angles, for which the lateral and elevation angles of the fixing members 120" coincide. Mounting device 105" may also include second fixing members at opposing ends of base plate 110" . Where second fixing members are included, one end of base plate 110" is provided with a pair of laterally spaced tabs, as previously described.

Thus, it can be seen that system 100 provides a means for increasing the efficiency of building construction, providing a quick and easy method for accurately setting angularly directed structural support members, such as trusses or hip, jack, valley, and common rafters, or the like, with proper spacing therebetween. System 100 further adds stability to the structure during the construction phase and increases the structural integrity of the completed building. A portion of the efficiency achieved by system 100 is a result of the use of C-shaped vertically directed channel members which form the fixing members 120, 120' and 120". The C-shaped channels are highly resistant to being deformed, as would otherwise result were the members formed by simple planar structures, which would be likely to bend while being transported or stored. Thus, when the mounting devices 105, 105', 105" are utilized, the construction personnel need not take time out to realign the fixing members 120, 120', 120", as such will be maintained in their proper orientation by virtue of the flanges 132 which extend on the two vertically directed sides thereof Although this invention has been described in connection with specific forms and embodiments thereof, it will be appreciated that various modifications other than those discussed above my be resorted to without departing from the spirit or scope of the invention, for example, equivalent elements may be substituted for those specifically shown and described, certain features may be used independently of other features, and in certain cases, particular locations of elements may be reversed or interposed, all without departing from the spirit or scope of the invention as defined in the appended Claims.

What is claimed is:

1. A system for positioning and securing angularly directed structural support members of a roof structure comprising at least a pair of mounting devices respectively mounted to corresponding surface portions of a pair of longitudinally extended and laterally spaced structural members, said pair of mounting devices each having a plurality of angularly directed -structural support member receiving spaces formed thereon in correspondence with- the other of said mounting devices, each of said mounting devices including:

(a) a longitudinally extended base plate having a plurality of longitudinally spaced first through holes formed therein through which fasteners pass for coupling said base plate to a respective longitudinally extended structural member; and, (b) a plurality of pairs of first fixing members respectively secured to said base plate, each said pair of first fixing members being disposed in opposing spaced parallel relationship to define a respective one of said receiving spaces therebetween for locating and securing a portion of a respective angularly directed structural support member to the corresponding longitudinally extended structural member, each of said first fixing members being formed by an angularly directed C-shaped channel member having a web portion bounded on two sides thereof by a pair of flanges extending substantially in said longitudinal direction.

2. The system as recited in claim 1 further comprising a pair of opposed second fixing members respectively secured to said base plate adjacent opposing ends thereof, each of said second fixing members being formed by an angularly directed C-shaped channel member having a web portion bounded on two sides thereof by a pair of flanges extending in said longitudinal direction, one of said second fixing members being secured to said base plate at an endmost location and the other of said second fixing members being secured to said base plate at a location from which a pair of laterally spaced tabs extend.

3. The system as recited in claim 2 where said pair of tabs extend longitudinally a distance substantially equal to a thickness dimension of a respective angularly directed structural support member received thereon.

4. The system as recited in claim 3 where said web portion of each of said first and second fixing members has at least one second through hole formed therein and said base plate has a plurality of openings formed therethrough respectively disposed between each said pair of first fixing members to facilitate toe nailing of the angularly directed structural members.

5. The system as recited in claim 1 where each of said first fixing members are directed at a lateral angle of inclination less than 90° with respect to a plane defined by said base plate.

6. The system as recited in claim 5 where each of said first fixing members are directed at an elevation angle less than 90° with respect to said plane.

7. The system as recited in claim 1 where each of said first fixing members are directed at an elevation angle less than 90° with respect to a plane defined by said base plate.

8. The system as recited in claim 5 where said lateral angle of inclination is normal to an inclination angle of the respective angularly directed structural support members.

9. The system as recited in claim 5 where said lateral angle of inclination is substantially equal to an inclination angle of the respective angularly directed structural support members.

10. The system as recited in claim 2 where each of said first and second fixing members are directed at a lateral angle of inclination less than 90° with respect to a plane defined by said base plate.

11. The system as recited in claim 10 where each of said first and second fixing members are directed at an elevation angle less than 90° with respect to said plane.

12. The system as recited in claim 10 where said lateral angle of inclination is normal to an inclination angle of the respective angularly directed structural support members.

13. The system as recited in claim 10 where said lateral angle of inclination is substantially equal to an inclination angle of the respective angularly directed structural support members.

14. A system for positioning and securing angularly directed structural support members of a roof structure comprising at least a pair of mounting devices consecutively mounted to a surface of a respective longitudinally extended structural member, each of said plurality of mounting devices having a plurality of angularly directed structural support member first receiving spaces formed thereon and forming an additional angularly directed structural support member second receiving space at an interface between said consecutively positioned pair of said mounting devices, each of said mounting devices including:

(a) a longitudinally extended base plate having a plurality of longitudinally spaced first through holes formed therein through which fasteners pass for coupling said base plate to the longitudinally extended structural member;

(b) a plurality of pairs of first fixing members respectively secured to said base plate, each said pair of first fixing members being disposed in opposing spaced parallel relationship to define a respective one of said first receiving spaces therebetween for locating and securing a portion of a respective angularly directed structural support member to the longitudinally extended structural member, each of said first fixing members being formed by an angularly directed C-shaped channel member having a web portion bounded on two sides thereof by a pair of flanges extending substantially in said longitudinal direction; and, (c) a pair of opposed second fixing members respectively secured to said base plate adjacent opposing ends thereof, each of said second fixing members being formed by an angularly directed C-shaped channel member having a web portion bounded on two sides thereof by a pair of flanges extending in said longitudinal direction, a first of said second fixing members being secured to said base plate at an endmost location and:the second of said second fixing members being secured to said base plate at a location from which a pair of laterally spaced tabs extend, said spaced tabs of one mounting device being disposed adjacent said first of said second fixing members of said consecutively positioned mounting device to define said second receiving space between said first of said second fixing members of one mounting device and said second of said second fixing members of the other mounting device.

15. The system as recited in claim 14 where said pair of tabs extend longitudinally a distance substantially equal to a thickness dimension of a respective angularly directed, structural support member received thereon.

16. The system as recited in claim 14 where said web portion of each of said first and second fixing members has at least one second through hole formed therein and said base plate has a plurality of openings formed therethrough respectively disposed between each said pair of first fixing members to facilitate toe nailing of the structural members.

17. The system as recited in claim 14 where each of said first and second fixing members are directed a lateral angle of inclination less than 90° with respect to a plane defined by said base plate.

18. The system as recited in claim 17 where each of said first and second fixing members are directed at an elevation angle less than 90° with respect to said plane.

19. The system as recited in claim 17 where said lateral angle of inclination is normal to an inclination angle of the respective angularly directed structural support members.

20. The system as recited in claim 17 where said lateral angle of inclination is substantially equal to an inclination angle of the respective angularly directed structural support members.

* * * * *